US007114876B1

(12) United States Patent
Allen et al.

(10) Patent No.: US 7,114,876 B1
(45) Date of Patent: Oct. 3, 2006

(54) ACOUSTICALLY MATCHED CONCRETE FINISHING PANS

(75) Inventors: J. Dewayne Allen, Paragould, AR (US); Richard P. Bishop, Fairfax Station, VA (US)

(73) Assignee: Allen Engineering Corporation, Paregould, AR (US)

( * ) Notice: Subject to any disclaimer, the term of this patent is extended or adjusted under 35 U.S.C. 154(b) by 27 days.

(21) Appl. No.: 11/018,192

(22) Filed: Dec. 21, 2004

Related U.S. Application Data

(62) Division of application No. 10/459,888, filed on Jun. 12, 2003, now Pat. No. 6,857,815.

(60) Provisional application No. 60/389,082, filed on Jun. 14, 2002.

(51) Int. Cl.
*E01C 19/22* (2006.01)

(52) U.S. Cl. ..... 404/112

(58) Field of Classification Search ..... 404/112
See application file for complete search history.

(56) References Cited

U.S. PATENT DOCUMENTS

| | | | |
|---|---|---|---|
| 3,936,209 | A | 2/1976 | Krage |
| 3,936,212 | A | 2/1976 | Holz, Sr. |
| 4,046,484 | A | 9/1977 | Holz, Sr. |
| D323,510 | S | 1/1992 | Allen |
| 5,108,220 | A | 4/1992 | Allen |
| 5,408,258 | A | 4/1995 | Kolessar |
| 5,480,257 | A | 1/1996 | Allen |
| 5,520,862 | A | 5/1996 | Face et al. |
| 5,527,175 | A | 6/1996 | Face et al. |
| 5,613,801 | A | 3/1997 | Allen |
| 5,685,667 | A | 11/1997 | Allen |
| 5,890,833 | A | 4/1999 | Allen |
| 6,019,545 | A | 2/2000 | Allen |
| 6,048,130 | A | 4/2000 | Allen |
| 6,053,660 | A | 4/2000 | Allen |
| 6,087,786 | A | 7/2000 | Allen |
| 6,089,787 | A | 7/2000 | Allen |
| 6,101,880 | A | 8/2000 | Face et al. |
| 6,106,193 | A | 8/2000 | Allen |

*Primary Examiner*—Gary S. Hartmann
(74) *Attorney, Agent, or Firm*—Stephen D. Carver

(57) ABSTRACT

Pans for power finishing freshly placed concrete in which the acoustic impedance of the treating equipment is made substantially equal to the acoustic impedance of the concrete slab being treated. Preferably, a powered, twin rotor riding trowel is provided with a pair of circular finishing pans that are attached to the conventional rotor blades used later in the finishing process. The pans are characterized by an acoustic impedance approximating the acoustic impedance of plastic concrete, thereby optimizing the energy transferred to the concrete. Preferred pans comprise ultra-high molecular weight polyethylene (UHMWPE) plastic. During troweling, the pans are frictionally revolved over the plastic concrete for finishing the surface without prematurely sealing the uppermost slab surface. Through the disclosed troweling method, a highly stable concrete surface results, and delamination is minimized. Alternative troweling uses pans coated with layered impedance matching material. Alternative equipment includes slip form pavers.

14 Claims, 16 Drawing Sheets

ACOUSTICALLY MATCHED CONCRETE FINISHING PANS

CROSS-REFERENCE TO RELATED APPLICATION

This is a divisional application based upon a prior application entitled Acoustic Impedance Matched Concrete Finishing, Ser. No. 10/459,888, filed Jun. 12, 2003 now U.S. Pat. No. 6,857,815, which was in turn based upon a previously filed provisional application Ser. No. 60/389,082, filed Jun. 14, 2002, which was entitled Acoustic Impedance Matched Concrete Finishing Equipment.

BACKGROUND OF THE INVENTION

1. Field of the Invention

This invention relates generally to powered, concrete finishing equipment for treating concrete surfaces, including motorized concrete trowels, vibrating screeds, and the like. More particularly, our invention relates to a system for maximizing the mechanical power inputted to freshly placed concrete by finishing machines of the aforementioned character, by matching the characteristic acoustic impedance of the parts said machines that contact said concrete surfaces to that of the freshly poured concrete.

2. Description of the Prior Art

A variety of relatively large, usually powered implements are well recognized in the concrete placement industry for finishing fresh concrete. For example, the prior art includes a vast number of differently-configured screeds and strike-offs comprising elongated spans of metal that directly contact freshly poured concrete.

Typical screeds may float upon the surface being treated, they may be suspended or supported between and upon suitable forms. Usually a plurality of spaced apart vibrators are rigidly mounted along the length of the screed or "strike-off" to vigorously distribute vibrational energy, as the raw concrete is pre-shaped and fresh concrete is struck off. As the freshly poured concrete hardens, subsequent finishing begins with pan-troweling.

While relatively small job applications are adequately finished with single-rotor "walk behind" trowels, larger self-propelled riding trowels, often equipped with multiple engines and power steering controls, can rapidly finish extremely large surface areas. High power riding trowels offer significant advantages well recognized in the art. Typical power riding trowels have two or more downwardly projecting rotors that contact the concrete surface and support the trowel weight. Each rotor comprises radially oriented, spaced-apart finishing blades that frictionally revolve upon the concrete surface. These blades secure circular finishing pans that start the panning process while the concrete is still green or plastic. When the rotors are tilted, steering and propulsion forces are frictionally developed by the blades (or pans) against the concrete surface, enabling the operator to control and steer the apparatus. Troweling typically commences with the panning of green concrete, and as the material hardens, troweling is concluded with the trowel blades after removing the pans.

Much activity in the concrete industry pertains to highway building. There are two basic methods of laying concrete pavement: fixed-form paving and slipform paving. Fixed-form paving requires the use wooden or metal side forms that are set up along the perimeter of the pavement before paving. Slipform paving does not require any steel or wooden forms. A slipform paving machine extrudes the concrete much like a caulking gun extrudes a bead of caulk for sealing windows. In general, slipform paving is preferred by contractors for large paving areas where it can provide better productivity with less labor than fixed-form paving.

There are a variety of different fixed-form paving machines. The least complex are vibratory screeds, and revolving tubes. These hand-operated machines finish the surface of the pavement between fixed forms. Larger, form-riding (or bridge deck) machines are self-propelled and also place and consolidate concrete between fixed forms. These machines either ride on the forms or pipes laid outside the forms, or on curb and gutter.

All slipform machines use the principle of extrusion. The manufacturers provide a variety of sizes for everything from municipal curb and gutter to airport work. Some machines are also equipped with automatic finishing equipment and equipment to automatically insert dowel bars into the pavement at transverse joints. These devices are called Dowel Bar Inserters or DBI's.

While paving, slipform paving machines are equipped with sensors to follow stringlines that are put into position along either side of the paving area. The stringlines control the paver direction and surface elevation. All slipform machines also are equipped with vibrators to help consolidate the concrete and ease the progress of paving by making the concrete more fluid. The vibrators are located toward the front of the machine ahead of its profile pan. The profile pan is the part of the paver that actually extrudes the concrete creating the final shape of the slab.

After the fixed-form or slipform equipment passes, most contractors have crew members use hand-tools to further finish the slab. These operations are called: finishing, floating or straightedging.

The entire set of paving and placing machines and activities is called the paving train. On a highway project the typical paving train consists of a spreader or belt placer, slipform paver, and curing and texturing machine. Smaller paving projects may use only the slipform machine. Many different moving parts can thus touch and shape the plastic concrete. It is our goal to modify said parts in an effort to streamline the application process, and to transfer as much energy as possible into the concrete "load" being manipulated by the concrete machinery.

Holz, U.S. Pat. No. 4,046,484, shows a pioneer, twin rotor, self-propelled riding trowel wherein the rotors are tilted to generate steering forces. U.S. Pat. No. 3,936,212, also issued to Holz, shows a three rotor riding trowel powered by a single motor. Although the designs depicted in the above two Holz patents were pioneers in the riding trowel arts, the devices were difficult to steer and control.

Prior U.S. Pat. No. 5,108,220, owned by Allen Engineering Corporation, the same assignee as in this case, relates to an improved, fast steering system for riding trowels. It incorporates a steering system to enhance riding trowel maneuverability and control. The latter fast steering riding trowel is also the subject of U.S. Des. Pat. No. 323,510, owned by Allen Engineering Corporation.

U.S. Pat. No. 5,613,801, issued Mar. 25, 1997, to Allen Engineering Corporation, discloses a power-riding trowel equipped with separate motors for each rotor. Steering is accomplished with structure similar to that depicted in U.S. Pat. No. 5,108,220 previously discussed.

Allen Engineering Corporation U.S. Pat. No. 5,480,258 discloses a multiple-engine riding trowel. Allen Engineering Corporation U.S. Pat. No. 5,685,667 discloses a twin engine riding trowel using "contra rotation."

Modern riding trowels, such as the Allen trowels with multiple motors listed above, are characterized by relatively high power. Simply stated, high-powered riding trowels with power steering and hydraulic controls finish extremely large concrete surfaces faster. Earlier riding trowels used manually-operated levers for steering—a design limitation that limited their effectiveness. Such trowels can be cumbersome to control, and the operator can fatigue relatively rapidly. Modern high-power trowels with features such as hydraulic power steering are much easier to control and they are less stressful to the operator. Allen Engineering Corporation, the owner of this invention, has developed high power, hydraulically controlled trowels illustrated in U.S. Pat. Nos. 6,106,193, 6,089,787, 6,089,786, 6,053,660, 6,048,130, and 5,890,833. It is now well recognized that power steering systems engender the maximum overall performance. Quick and responsive handling characteristics optimize trowel efficiency, while contributing to operator safety and comfort.

The forces exerted upon concrete by the blades or body of the chosen finishing device are many. For example, frictional forces are developed and experienced by blade contact upon the concrete surface as the trowel rotors, from which they project, forcibly revolve. Compressive forces are applied at the surface by the distributed weight of the finishing apparatus. Most importantly, a variety of forces are applied throughout the partially uncured slab by the trowel.

Vigorous vibrational forces developed and distributed by finishing screeds help solidify concrete, and, importantly, water is encouraged to migrate to the surface. Proper setting during the finishing process enhances surface quality, and minimizes delaminating problems. If vibrational screeding is optimally conducted immediately after a pour, a stronger, more chip-resistant concrete surface will result, thereby minimizing unwanted delamination.

Power trowels develop vibrational forces largely as a consequence of the high powered motor or motors, the drive train, and blade or pan contact in response to rotor rotation. Local variations in the coefficient of friction and in the inertial and gravitational forces applied to the surface of the concrete result in rapid and irregular changes in these forces. The result is intense and constant vibration that is applied to the surface of the concrete.

When poured, concrete is still uncured, trowel panning proceeds. It is well recognized that optimal panning contributes to the production of a flat, smooth and uniform surface, reducing the likelihood of subsequent delamination. Shortly thereafter the trowel pans are removed and blade-troweling can enhance the finishing process by providing a highly polished surface of desired hardness. Through each of these processing stages, the vibrational energy acts on the concrete as it progresses through the finishing process. Numerous vibrational forces are generated intentionally during concrete finishing. For example, common screeds distribute vibration generated by mechanical vibrators secured to their frame.

However, much vibrational energy imparted to the concrete during finishing originates from inherent vibrations caused by a combination of sources. Vibration results from motors and rotating parts, from equipment friction, from pressures applied by the apparatus upon the surface, and from movement of the trowel over the surface. The results of that action can be either useful and helpful or harmful and ineffectual depending upon the nature of the vibration and upon the condition of the concrete when it is applied.

The amount of energy that is introduced to the concrete from the finishing equipment depends upon the intensity of the applied forces and the amount of energy that is reflected back from the concrete toward the energy source. Various physical properties of the vibrating equipment and of the concrete being finished affect the energy transmission rate and efficiency. Parameters affecting the rate of transmission and reflection of acoustic energy relate to acoustic impedance. When the acoustic impedance of the energy source substantially equals that of the energy destination, the impedances are "matched" and there is no reflection of the acoustic energy away from its destination back toward its source.

The basic method of matching acoustic impedances consists of mechanically joining a source of sound energy—a vibrator or a loudspeaker or some other source—to another object that is to be vibrated such as your eardrum or a microphone. There may in fact be several linked objects in an acoustic power train. In the most general form, there is a source of sound energy (such as a converter of electrical energy to mechanical energy, represented by the voice coil in a loudspeaker) and an absorber of sound energy (such as the load to which sound energy is applied.)

In each stage of the power train, where the form of acoustic energy is altered or where the medium in which the energy travels is changed, there exists an interface through which the energy moves. This discussion assumes that the interface is an abrupt change in nature, but it may actually be a continuous transition having a gradually changing nature. It is the impedance variation at each interface that determines the nature of energy transmission.

The energy at each interface will undergo some combination of transmission (passing through it) and reflection (reflection from it), depending upon the impedance relationship. When sound impinges on an interface where the direction of propagation is at an angle to the interface, the sound may also be bent (refracted), but in this discussion we are only considering cases where the direction of propagation is normal to (perpendicular to) the interface. The transmission coefficient, the fraction of the energy that is transmitted through the interface, is:

$$T=(4Z_1*Z_2)/(Z_1+Z_2)^2$$

where $Z_1$ and $Z_2$ are the acoustic impedances before and after the interface. Conservation of energy requires that the sum of the reflected energy and the transmitted energy totals the incident energy; there is no loss within the interface, which is a dimensionless surface rather than a physical object. The reflection coefficient, the fraction of the energy that is reflected from the interface, is 1−T.

It is not readily apparent that the transfer of energy from a concrete finishing tool (trowel, float, etc.) to the concrete being finished is an acoustic process. It is not enough to say "it makes a noise"—although it does. The noise itself is certainly acoustic in nature. The fundamental factor is that there is a transfer of energy. If there were none, then troweling would have no finishing effect and it would have no lasting influence on the concrete. Since energy is transferred, and since there is no significant net change in the elevation of the concrete resulting from troweling, the only mechanism for energy transfer is the input of mechanical oscillation, which is acoustics.

Recognizing that many of the aspects of working with concrete involve the transfer of acoustic energy, it becomes easier to understand the physical mechanisms of such concrete work. For example, in the past we have asked the question "Why do floats made of wood or magnesium bring up water and fines while steel floats seal the surface, trapping the fines and water?" No one had any answer except some form of "It has always worked that way."

The frequency distribution of the vibrational energy applied by typical finishing machines of the character described is concentrated within relatively narrow bands of acoustic frequencies. As will be recognized by those with skill in the acoustic arts and/or familiarity with wave transmission theory in physics, the concrete masses being vibrated have a characteristic acoustic impedance. Further, the finishing machinery involved exhibits a characterized acoustic "output impedance." Those with skill in the art of physics will appreciate the fact that, in general, the energy transfer between a given "source" and a given "load" will be optimal when the impedance of the load is approximately the same as the impedance of the source. This general principle finds examples in radio antenna theory, acoustic audio applications, and in kinetics of moving systems. We have postulated and experimentally confirmed that the vibrational energy transferred into a concrete slab by a given finishing machine will be maximized when and if the load impedance that the machine experiences is approximately the same as the machine output impedance.

Stated another way, energy transfer will be maximum when there is a minimal acoustic "standing wave ratio" (i.e., "SWR."), which ideally should approach 1:1. Typically however, with prior art concrete finishing devices known to us, there is an appreciable mismatch between the acoustic load impedance characterizing the concrete slab, and the acoustic output impedance exhibited by the finishing machine. As the realized SWR greatly exceeds 1:1, energy that could otherwise be imparted into the concrete "load" is instead "reflected" back into the machine, unnecessarily shaking its structure and in the case of riding trowels, the machine operator. Since acoustic energy is transferred in the process, it is natural to look at the acoustic impedances of the interfaces.

Concrete also has characteristic impedance values which change as the concrete changes—sets and cures. Values of impedance for a typical unvibrated concrete as it ages are tabulated below:

TABLE 1

Concrete Impedance At Time After Initial Placement

| Condition: | Fresh | 2 hour | 3 hour | 4 hour | 6 hour | 10 hour | 4 day | Cured |
|---|---|---|---|---|---|---|---|---|
| Impedance: | 2.7 | 2.8 | 2.3 | 4.0 | 6.0 | 8.0 | 10.0 | 12.0 |

One possibility for our method is the use of an impedance matching insert, or transmission plate. Considering the simplified case where energy is assumed to be transmitted into the concrete in a direction normal to the surface being finished, two conditions are required to approach 100% transmission of the energy into the concrete (i.e., an acoustic SWR of 1:1). In general, the required characteristic impedance $Z_o$ of a quarter wave matching section applied between a source impedance, $Z_s$ and a load $Z_R$ is governed by the relationship: $Z_o^2=(Z_s^2*Z_R^2)$.

The specific acoustic impedance of the transmission plate is the square root of that of the source and destination layers: $\Delta_{II}c_{II}=(\Delta_I c_I*\Delta_{III}c_{III})^{1/2}$, where $\Delta$ is the material density, c is the speed of sound in the material, and $_{I, II}$ and $_{III}$ refer to the source layer, the transmission plate, and the destination layer respectively. Using the physical properties given in the table below, and assuming that the energy source is made of steel, the transmission plate must have an impedance of about $10.8\times10^6$N–s/m.$^3$

TABLE 2

Selected Acoustic Properties

| Material | Speed of sound (m/sec) | Density(kg/m$^3$) | Acoustic Impedance (N s/m$^3$ × $10^{-6}$) |
|---|---|---|---|
| fresh concrete | 1000 | 2500 | 2.5 |
| Magnesium | 5800 | 1740 | 10.1 |
| steel | 5900 | 7860 | 46.4 |
| Granite | 3950 | 2750 | 10.9 |

The second required condition is that the thickness of the transmission plate equals one-quarter wavelength of the transmitted sound. Although the vibrational energy extends across a spectral band of frequencies, because of phenomena called "resonance", maximal energy will be concentrated in a relatively dominant frequency. When the frequency of operation is fixed by an active transmitter or by a frequency-selective aspect of the system, design is simple; at other times, a resonant condition may determine the operating frequency. More generally, a combination of circumstances will set a range of frequencies. Testing of the equipment will provide design information. If there are no other frequency-determining factors, selection of a transmission plate thickness will force the system to operate at the condition of maximum transmission power based on the same quarter-wavelength criterion. Then, thickness selection will result in setting a resultant frequency that maximizes transmitted power.

For example, if power is to be provided to a four-inch thickness of concrete then it will be most effective when the frequency of operation corresponds to that thickness representing a quarter-wavelength of the sound energy. Fresh concrete has a sound speed of close to 1000 meters per second, so a quarter wavelength of four inches (0.1 meters) occurs at 2500 Hz. The transmission plate then will have an optimum thickness of:

TABLE 3

Suggested Transmission Plate Thickness

| Material: | Suggested Thickness: |
|---|---|
| Magnesium | 22.8 inches |
| Granite | 15.6 inches |

Neither of these thicknesses are practical for concrete finishing equipment, but they illustrate what is theoretically possible. It is also possible to match acoustic impedance by fabricating an impedance transmission plate made from two different materials, with each material having an acoustic impedance equal to one of the two terminating impedances. For a steel-to-fresh-concrete transition, one material would require an impedance of 2.5 (perhaps beechwood where it is 2.51) and the other would be made of steel. The two pieces, one made from each material, are simply glued together. The preferred system provides a means wherein the characteristic acoustic impedance of a finishing machine is matched to the acoustic impedance of the concrete load.

Tables 4 and 5 show the resultant transmission coefficients for the tabulated concrete impedances during the setting and curing cycle given on the previous page. The energy transfer characteristics are given for likely trowel materials, i.e., for some likely metal blade and pan materials and for some possible plastic and wood materials that may have more favorable properties.

TABLE 4

Interface Transmission Coefficient: Common Metals

| Age-hours | Fraction Transmitted | | | | |
|---|---|---|---|---|---|
| | MAGNE-SIUM | ALUMI-NUM | TITA-NIUM | BRASS | STEEL |
| 1 | 0.68 | 0.48 | 0.34 | 0.24 | 0.21 |
| 2 | 0.69 | 0.49 | 0.35 | 0.25 | 0.22 |
| 3 | 0.71 | 0.50 | 0.36 | 0.26 | 0.23 |
| 4 | 0.57 | 0.39 | 0.27 | 0.19 | 0.17 |
| 5 | 0.73 | 0.53 | 0.38 | 0.27 | 0.24 |
| 6 | 0.81 | 0.61 | 0.45 | 0.33 | 0.29 |
| 7 | 0.89 | 0.70 | 0.53 | 0.39 | 0.35 |
| 8 | 0.94 | 0.76 | 0.60 | 0.45 | 0.41 |
| 9 | 0.97 | 0.82 | 0.65 | 0.50 | 0.46 |
| 10 | 0.99 | 0.86 | 0.71 | 0.55 | 0.50 |

TABLE 5

Interface Transmission Coefficient: Common Woods

| Age-hours | Fraction Transmitted | | | | | | | |
|---|---|---|---|---|---|---|---|---|
| | PINE | LDPE | FIR | HDPE | BEECH | UHMW | TEF-LON | PVC |
| 1 | 0.94 | 0.96 | 0.98 | 0.99 | 1.00 | 1.00 | 1.00 | 0.99 |
| 2 | 0.93 | 0.96 | 0.97 | 0.99 | 0.99 | 1.00 | 1.00 | 1.00 |
| 3 | 0.92 | 0.95 | 0.97 | 0.98 | 0.99 | 1.00 | 1.00 | 1.00 |
| 4 | 0.99 | 1.00 | 1.00 | 1.00 | 0.99 | 0.98 | 0.97 | 0.95 |
| 5 | 0.91 | 0.94 | 0.96 | 0.97 | 0.98 | 0.99 | 1.00 | 1.00 |
| 6 | 0.84 | 0.87 | 0.90 | 0.93 | 0.95 | 0.96 | 0.98 | 0.99 |
| 7 | 0.76 | 0.80 | 0.83 | 0.86 | 0.89 | 0.91 | 0.94 | 0.96 |
| 8 | 0.69 | 0.73 | 0.77 | 0.80 | 0.83 | 0.86 | 0.89 | 0.92 |
| 9 | 0.63 | 0.67 | 0.71 | 0.74 | 0.78 | 0.80 | 0.84 | 0.87 |
| 10 | 0.58 | 0.62 | 0.66 | 0.69 | 0.73 | 0.75 | 0.79 | 0.83 |

When mechanical energy is generated at the interface between the trowel and the concrete surface, it can be transmitted into the body of the concrete to the degree that the transmission coefficient (T) permits. As seen above, several materials have T quite close to 1 while the concrete is fairly fluid; in this case, up to about four hours after the pour. Specifically, HDPE (high-density polyethylene), beech wood and UHMW (ultra-high molecular weight polyethylene) have excellent transmission of acoustic energy into concrete up to the point where transfer of water and fines from the concrete interior is complete. These materials, especially UHMW since it has adequate abrasion resistance, will make excellent power (or manual) trowel blades or pans. Under slurry-abrasion tests, UHMW is five times more abrasion resistant than steel; performance under troweling conditions has been proven substantially similar. At this point, we have thus determined that trowels must be improved to more adequately seal the concrete surface.

When concrete has hardened and water and fines have been adequately removed, the impedance of the concrete increases to the point where transmission coefficient is too low. The energy applied to the concrete interface is no longer absorbed into the body of the concrete. It is not completely clear what the actual mechanism is, and where the acoustic energy goes, but it seems likely that it is trapped at the interface and that most of the energy is converted to heat. Before the energy transfer behavior is finally known there will have to be some careful experimentation. The result on the concrete surface—hardening, sealing the surface, and development of an impermeable shiny coating, is consistent with what might be expected from interfacial heating and friction.

Magnesium exhibits favorable characteristics as a trowel material. From 75% to almost 100% of the interfacial energy is passed into the concrete with this troweling metal. In comparison, steel only permits 25% to 50% of the energy to pass into the concrete—a good explanation of why steel causes sealing of the concrete surface and the entrapment of water inside it. However, magnesium is not as advantageous for optimizing acoustic energy transfer as wood or plastic.

SUMMARY OF THE INVENTION

The present invention enhances concrete finishing processes, i.e., troweling, by adjusting the nature and intensity of the forces applied to the concrete that effect its quality and performance. Through the methods and apparatus disclosed herein, concrete surfaces of superior characteristics are obtained. More specifically, the common industry problem of delamination is minimized.

In accordance with the invention, concrete is first poured at a desired site through conventional methods. Known power screeding and vibration techniques are preferably employed during pouring. While forms are preferred, they are not mandatory. The rough and raw concrete slab is power-toweled as soon as it can bear the weight of the power finishing equipment.

According to our invention, it is recognized that the freshly placed concrete exhibits an approximate characteristic acoustic impedance range. Further, it is important that the characteristic acoustic impedance of the treating equipment is "optimized" with respect to the acoustic impedance of the concrete slab being treated. In other words, we have determined that the effective acoustic impedance of the treating equipment be matched with the acoustic impedance of the concrete. Thus, for example, during the panning of green concrete, the characteristic acoustic impedance of the pan material should be approximately the same as the impedance of the green concrete being treated.

Preferably a powered, twin rotor riding trowel is provided with a pair of circular finishing pans adapted to be attached to the conventional rotor blades used later in the finishing process as the slab cures. Suitable pans may be made from a variety of materials, all of which are characterized by an acoustic impedance approximating the acoustic impedance of green concrete. With the impedances approximately matched as aforesaid, energy transfer from the finishing machine to the slab being treated is maximized. Additionally, we have proposed improvements in slip form paving machinery.

The process of maximizing the energy transfer promotes high quality finishing, and minimizes the troweling time required. It is suggested that by maximizing the energy transferred, and thus minimizing the troweling time required, that power trowels with reduced horsepower may be used. Further, it is thought that by reducing the required troweling time, surface characteristics that resist delamination are more likely obtained. During troweling the pans are frictionally revolved over the green concrete for finishing the surface without prematurely sealing the uppermost slab surface. Through the disclosed troweling method, a highly stable concrete surface results, and delamination is minimized.

While the pans must be impedance matched, mechanical durability and wear characteristics must be considered as well. Preferred pans comprise ultra-high molecular weight polyethylene (UHMWPE) plastic, which provides durability and suitable frictional characteristics. An alternative-troweling concept uses steel pans coated with one or more layers of impedance matching material.

Thus a basic object of our invention is to increase the efficiency of concrete finishing methods and apparatus.

Another basic object is to provide a system for power concrete finishing devices that delivers an enhanced amount of energy to the concrete.

Another basic object is to optimize the power transferred into concrete by powered finishing machines, including riding trowels, slip form pavers, powered screeds and the like.

A related fundamental object is to match the acoustic impedance of concrete finishing machines to that of the concrete being finished.

More particularly, it is an important object to match the acoustic impedance of troweling pans to the acoustic impedance of green concrete.

A basic object is to improve the quality of treated concrete structures.

Similarly, it is an important object to minimize delamination, which often deleteriously characterizes conventionally treated slabs.

Another simple object is to efficiently couple vibrational energy generated by typical concrete finishing machines to the concrete load or mass undergoing placement and treatment.

A more specific object is to substantially match the characteristic acoustic impedance of the concrete masses being treated to the characteristic output impedance of the finishing equipment.

A related object is to adapt concrete finishing machines such that they output energy into a favorable acoustic impedance standing wave ratio.

Another basic object is to provide a system capable of matching acoustic impedance that is suitable for use with conventional screeds, walk behind trowels, and power riding trowels having two or more rotors.

A further object is to provide an acoustic impedance transformation system of the character described that is readily compatible with conventional trowel blades, combo-blades, or finishing pans.

Another object is to provide a system of the character described that may be easily retrofitted to existing power finishing equipment without substantial mechanical alterations.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and are to be construed in conjunction therewith, and in which like reference numerals have been employed throughout in the various views wherever possible.

DETAILED DESCRIPTION

Figure 1:
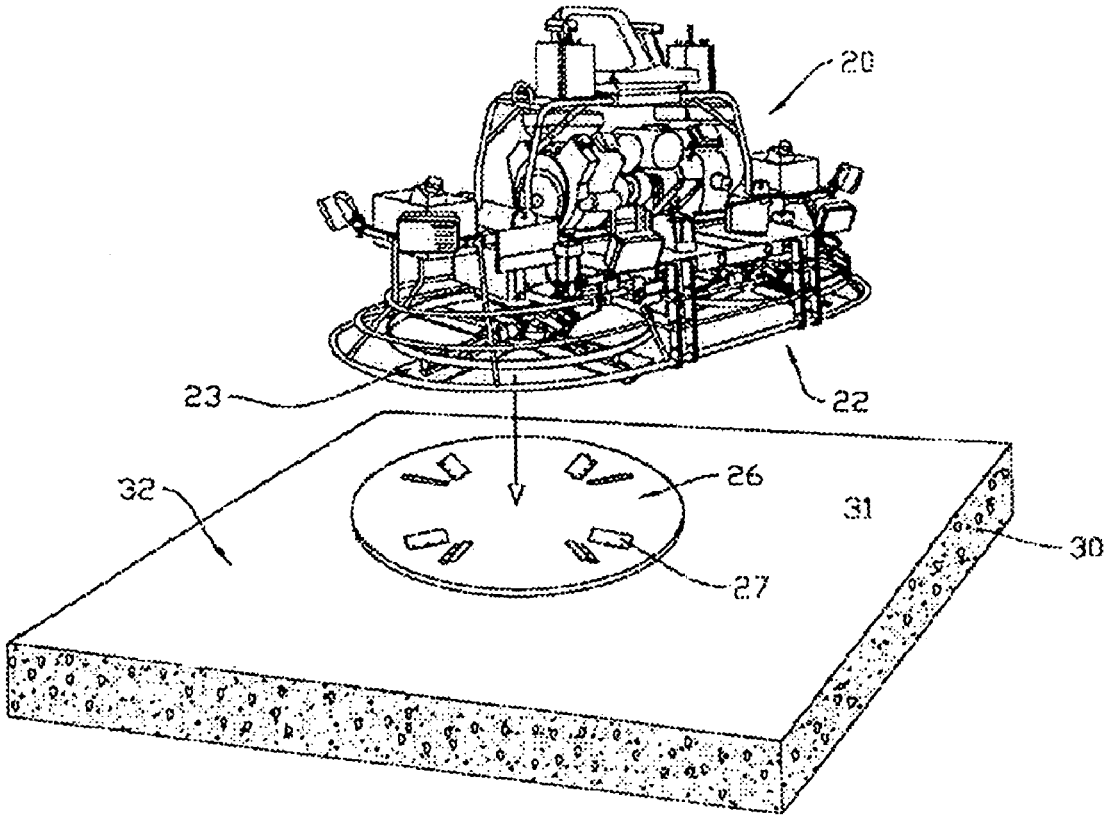
FIG. 1 is a partially exploded, fragmentary isometric diagrammatic view illustrating the preferred method and apparatus.

With initial reference directed now to FIGS. 1–6 of the appended drawings, a typical power riding trowel 20 comprises a pair of downwardly projecting rotors 22, each of which can receive a conventional steel finishing pan 21 (FIG. 5) for troweling green concrete, as is known in the art. However, pan 26 (FIGS. 1, 6) is constructed of materials whose acoustic impedance approximates that of the green concrete 30 comprising slab 32 (FIG. 1). Finishing pans 21, 26 have conventional brackets 27 adapted to be coupled directly to the rotor blades 23 in the operation of treating green concrete. During the initial stages of troweling, when pans are used, they frictionally contact the concrete surface 31 (FIG. 1); however, after the slab 32 hardens, the pans are removed and blades 23 directly polish the surface 31, generating a hard, impact-resistant outer surface.

Structural details of pertinent riding trowels illustrating basic structural concepts are set forth in detail in prior U.S. Pat. Nos. 5,108,220, 5,613,801, 5,480,257, 5,685,667, 5,890,833, 6,019,545, 6,048,130, 6,053,660, 6,089,786, 6,089,787, and 6,106,193, which, for disclosure purposes, are hereby incorporated by reference herein. The new concepts of this invention may be used with trowels from various manufacturers of different configurations and sizes.

Figure 2:
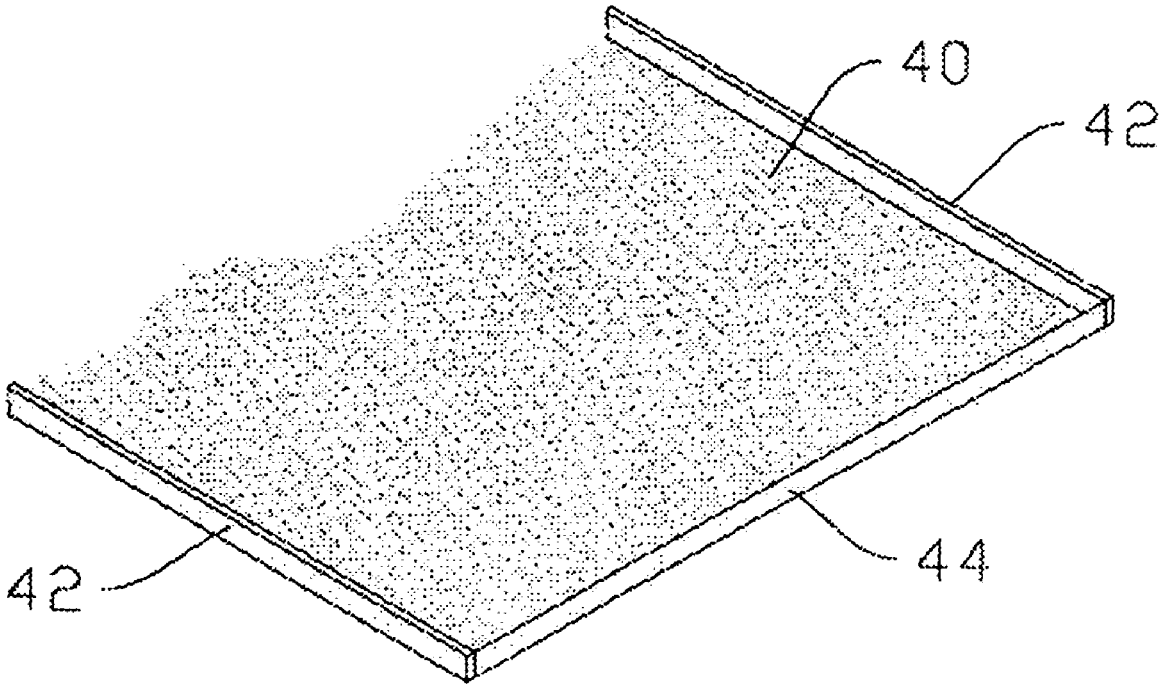
FIG. 2 is a fragmentary isometric view of a typical construction sub grade upon which concrete is to be poured.
Figure 3:
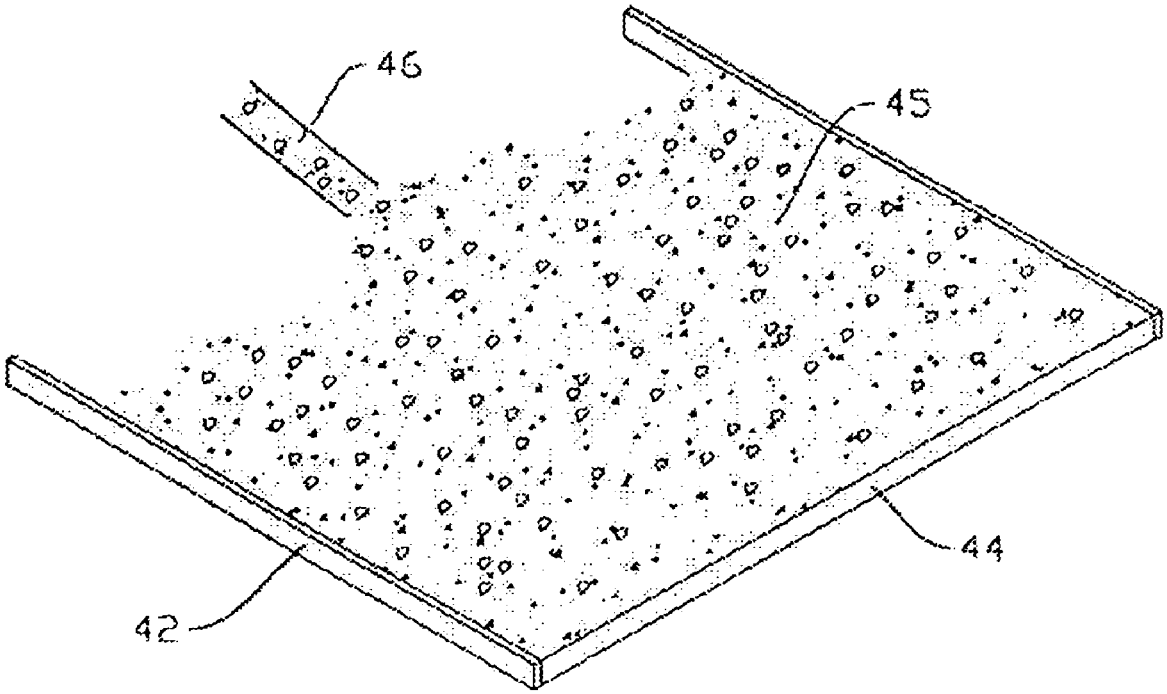
FIG. 3 is a fragmentary isometric view similar to FIG. 2, showing the preliminary placement of raw concrete upon the sub grade.
Figure 4:
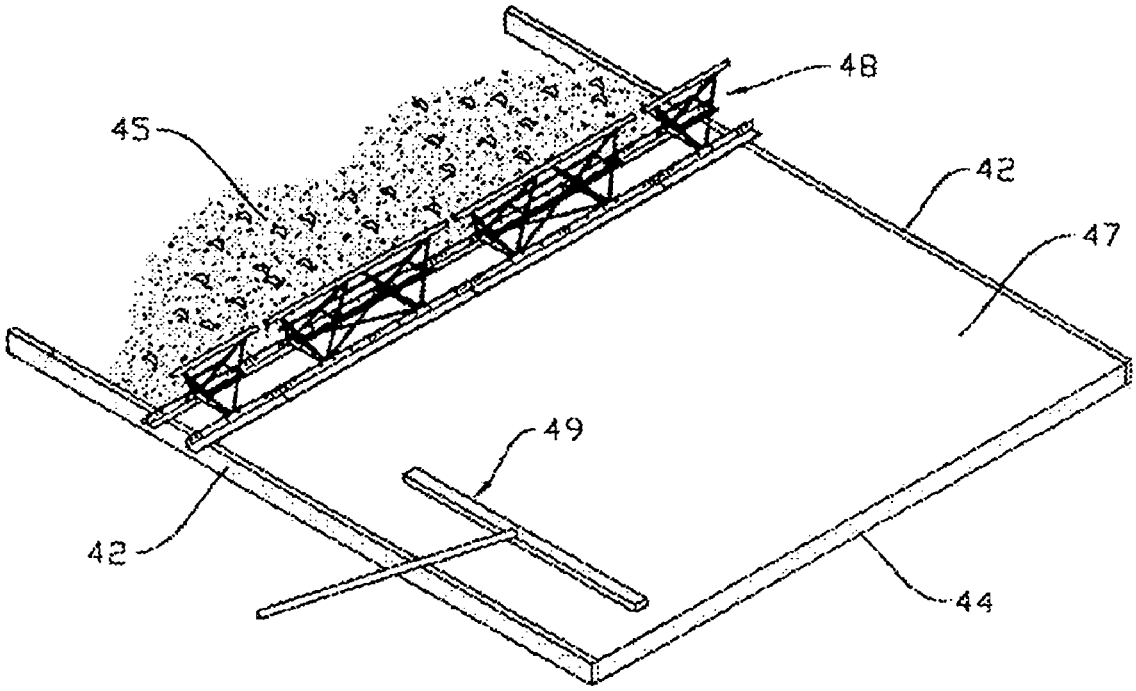
FIG. 4 is a fragmentary isometric view similar to FIGS. 2 and 3, illustrating a typical screed and strike-off operation.
Figure 5:
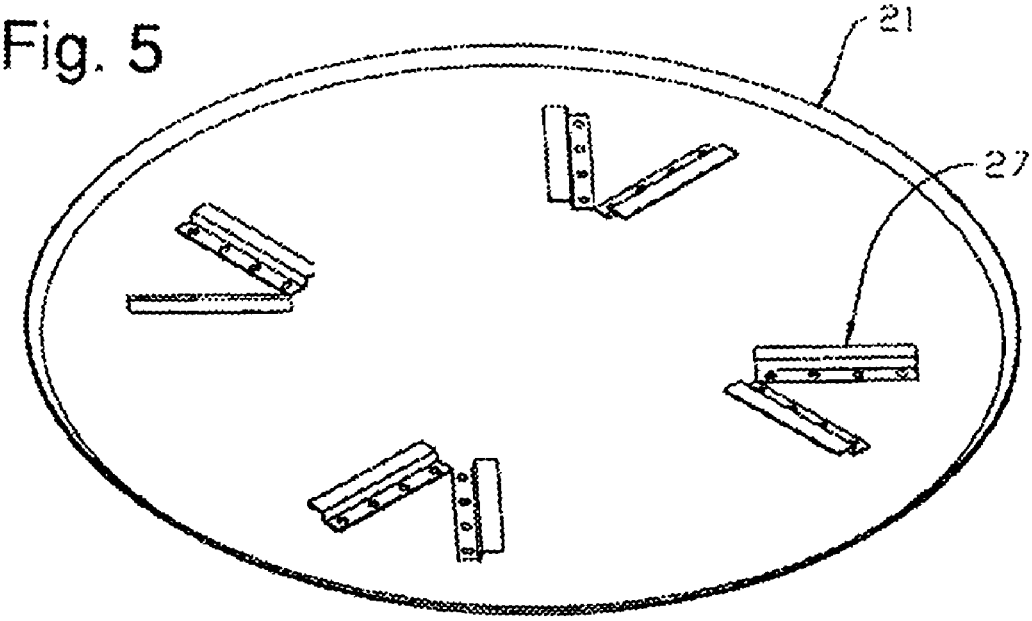
FIG. 5 is a top isometric view of a conventional steel-finishing pan adapted to be coupled to the blades of a conventional riding trowel rotor.

As recognized by those with skill in the art, a selection and preparation of a suitable subgrade 40 (FIG. 2) precedes the normal placement process. Appropriate forms 42 may confine the subgrade, and one or more transverse headers 44 are typical. By way of example, as raw concrete 45 is discharged from the delivery truck chute 46, it will spread throughout the slab area defined between forms 42 and headers 44 (FIGS. 2, 3). Normally the rough concrete 45 will be hand-manipulated by the crew members and distributed evenly between the forms. A conventional vibrating screed 48 suspended upon and between forms 42 moves towards the left (i.e., as viewed in FIG. 4), thereby striking off the rough concrete 45, and yielding the flattened slab region 47 (FIG. 4). At this point it is common to treat any remaining surface mars, bumps or irregularities with suitable hand tools such as the bull float 49. Shortly after screeding the slab, it will have sufficient strength to support the weight of the trowel 20. Panning starts the process while the concrete is still green. Once the concrete sufficiently hardens, the pans are removed and the rotor blades directly polish the surface.

Figure 6:
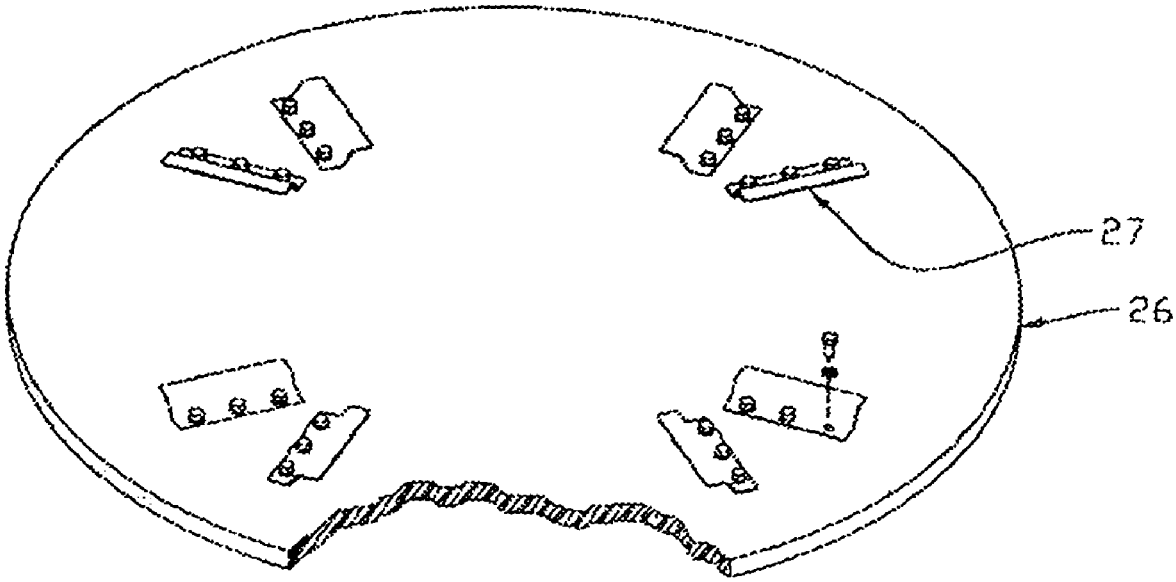
FIG. 6 is a partially, fragmentary, top isometric view of a finishing pan constructed in accordance with the best mode of the invention.

In FIG. 6 the improved pan 26 is seen to be generally circular like conventional steel pan 21. Preferred pans comprise ultra-high molecular weight polyethylene (UHMWPE) plastic, as represented in cross section in FIG. 6. When the pan is mounted, brackets 27 contact the rotor blades 23, which rest upon the upper surface 36 of pan 26 (FIG. 6).

Figure 7:
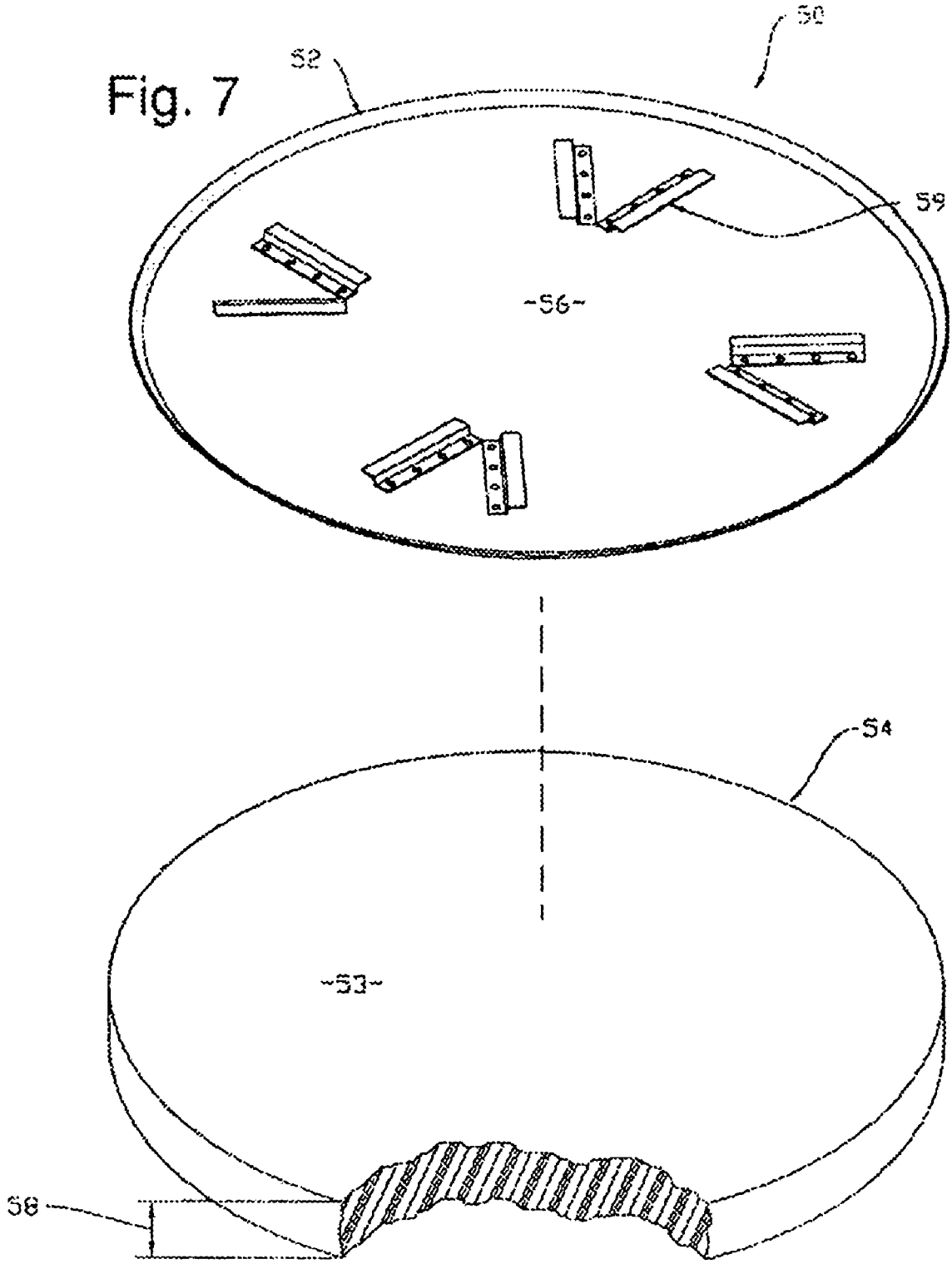
FIG. 7 is an exploded, partially, fragmentary, isometric view of an alternative finishing pan having a metallic frame and a lower, plastic impedance matching layer.

FIG. 7 reveals an alternative pan arrangement, generally designated by the reference numeral 50. In this instance, a preferably metallic subframe 52 resembling a conventional steel pan 21 as discussed earlier is used to support a lower impedance matching layer 54. Layer 54 is coaxially and rigidly beneath subframe 52, i.e., underside of subframe 52 is flatly secured to the upper surface 53 of layer 54. The interior surface 56 of subframe 52 is directly contacted by the rotor blades 23 as before, which contact brackets 59. The thickness of the impedance matching layer 54, designated by arrow 58 (FIG. 7) approximates a quarter wavelength (i.e., at the speed of sound in the medium) at the frequency of interest. Preferably, the layer 54 may comprise UHMWPE plastic as before.

In a preliminary test, pans made in accordance with FIG. 6 were mounted upon riding trowels similar to trowel 20 (FIG. 1) described earlier. A subgrade was prepared, forms erected, and concrete was applied. Three separate slabs resembling the aforedescribed arrangement were prepared, using different concrete air percentages. Pan impedance is ideally between 67% to 150% of the impedance of the green concrete.

TABLE 6

| | Treated Slab Parameters | | | | | | |
|---|---|---|---|---|---|---|---|
| Slab No. | Slump (in) | Air (%) | Unit Wt. (pcf) | Ambient Temp. | Concrete Temp. | Cylinders Per Set | Time Cast |
| Act-1 | 4.25 | 6.5 | NT | 80 | 84 | 3 | 9:00 am |
| Act-2 | 3.00 | 5.5 | NT | 87 | 87 | 3 | 1:45 pm |
| Act-3 | 4.75 | 3.5 | NT | 88 | 87 | 2 | 2:45 pm |

After placement and vibrational screeding, spectrum analysis of the sound frequencies within each slab were observed and processed during panning, both with steel pans and our new pan. To study and evaluate the effect of matching the acoustic impedance of concrete finishing equipment on the performance of the finishing process, measurements of the energy of vibration induced in the concrete slab, as a function of frequency, were made for equipment having different values of acoustic impedance. The experimental setup included the following: Vibration sensors (for ambient sound level in air in the vicinity of the tested equipment); Don Bosco Electronics, Inc. SA-116 Dynamic Microphone Probe (for vibration induced into the concrete slab); Don Bosco Electronics, Inc. SA-112 Vibration Pickup; Frequency Spectrum Analyzer; Hewlett-Packard HP3561A Signal Analyzer.

The sensors were attached to the spectrum analyzer using 75 feet of RG-59A coaxial cable attached using BNC connectors. Frequency spectra were collected by photographing the HP3561 Å CRT screen using a Kodak 211 digital camera. All of the sample spectra have a vertical axis representing acoustic energy in units of dB(v), with scale values of −131 dB(v) minimum to −41 dB(v) maximum. The horizontal axis of the spectra represents frequency, ranging from 10 Hz to 10,010 Hz, logarithmically scaled.

For in-air spectra the microphone was positioned approximately six feet away from the operating trowel. For in-concrete spectra the vibration sensor probe was inserted vertically into the concrete to a maximum depth of 1.25 inches. The trowel was positioned so that the edge of the rotating pans was about six inches away from the axis of the probe.

Figure 8:
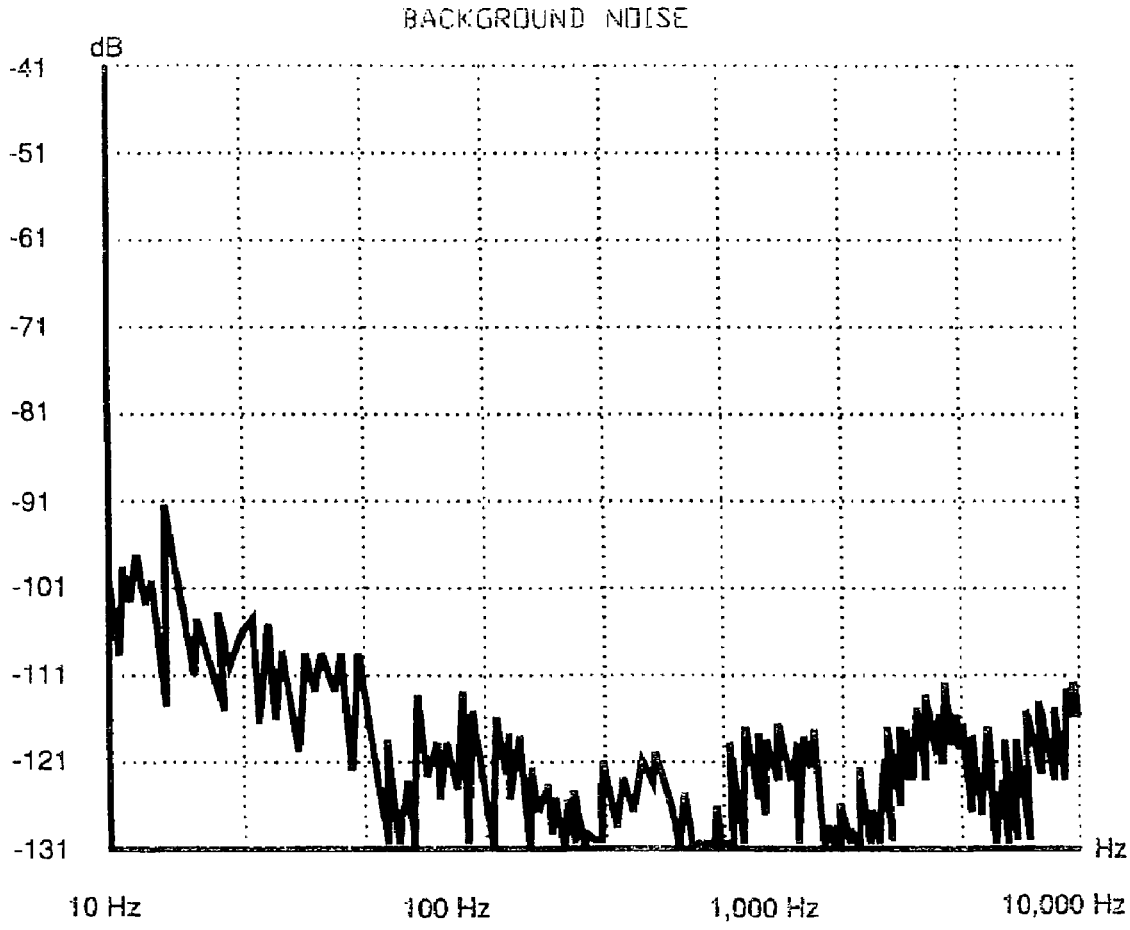
FIG. 8 is a semi-logarithmic graph plotting observed acoustic frequencies against intensity, in which noise from an idling trowel has been measured and plotted.
Figure 9:
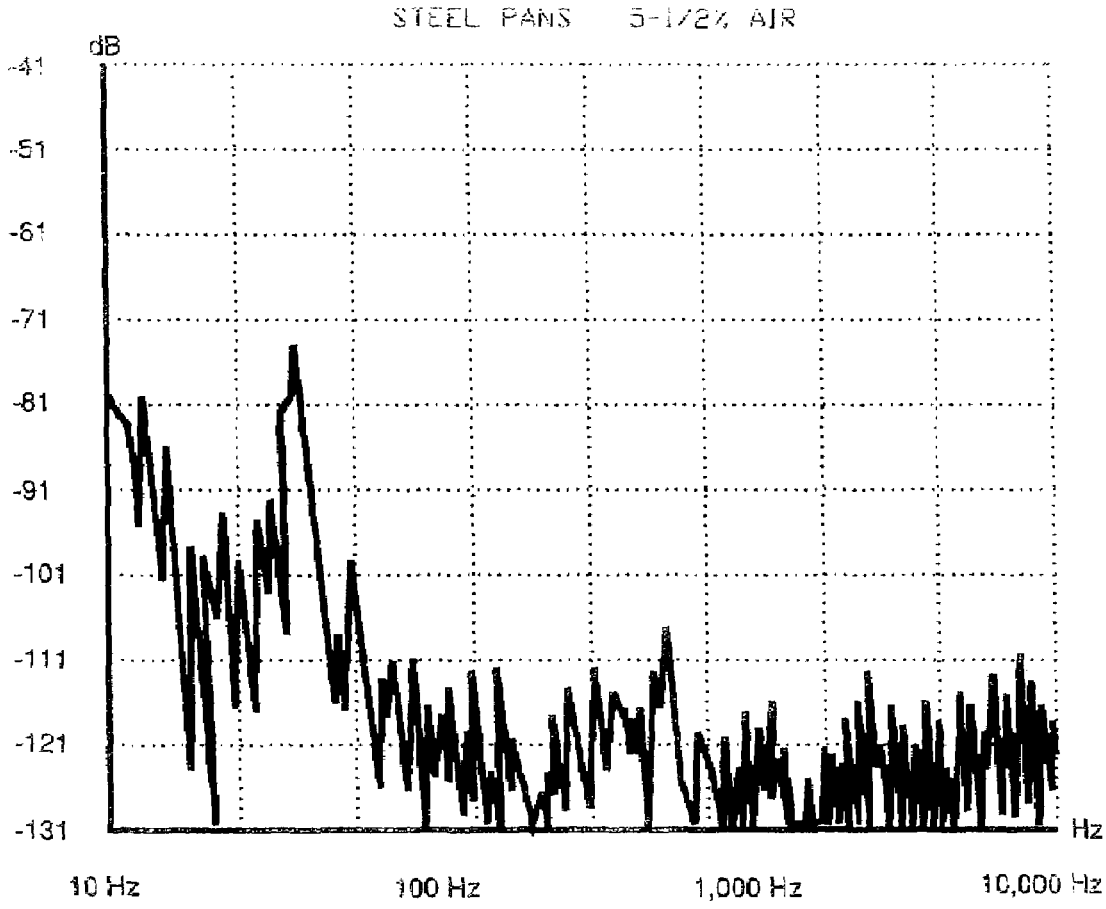
FIG. 9 is a graph similar to FIG. 8 showing observed acoustic energy in a slab with 5.5% air entrainment that is being troweled with conventional steel pans.

Typical frequency spectra are included. FIG. 8 depicts the ambient background noise in the vicinity of the operating "rider trowel." The region of significant energy level lies below 50 Hz, with intensity less than −90 dB(v). Above a frequency of 50 Hz, the energy level remains less than −115 dB(v). FIG. 9 depicts a trowel having a steel pan, operating over air-entrained concrete. There is significant energy at frequencies below 60 Hz where the vibration intensity varied between −90 to −75 dB(v). The maximum intensity occurred at about 50 Hz.

Figure 10:
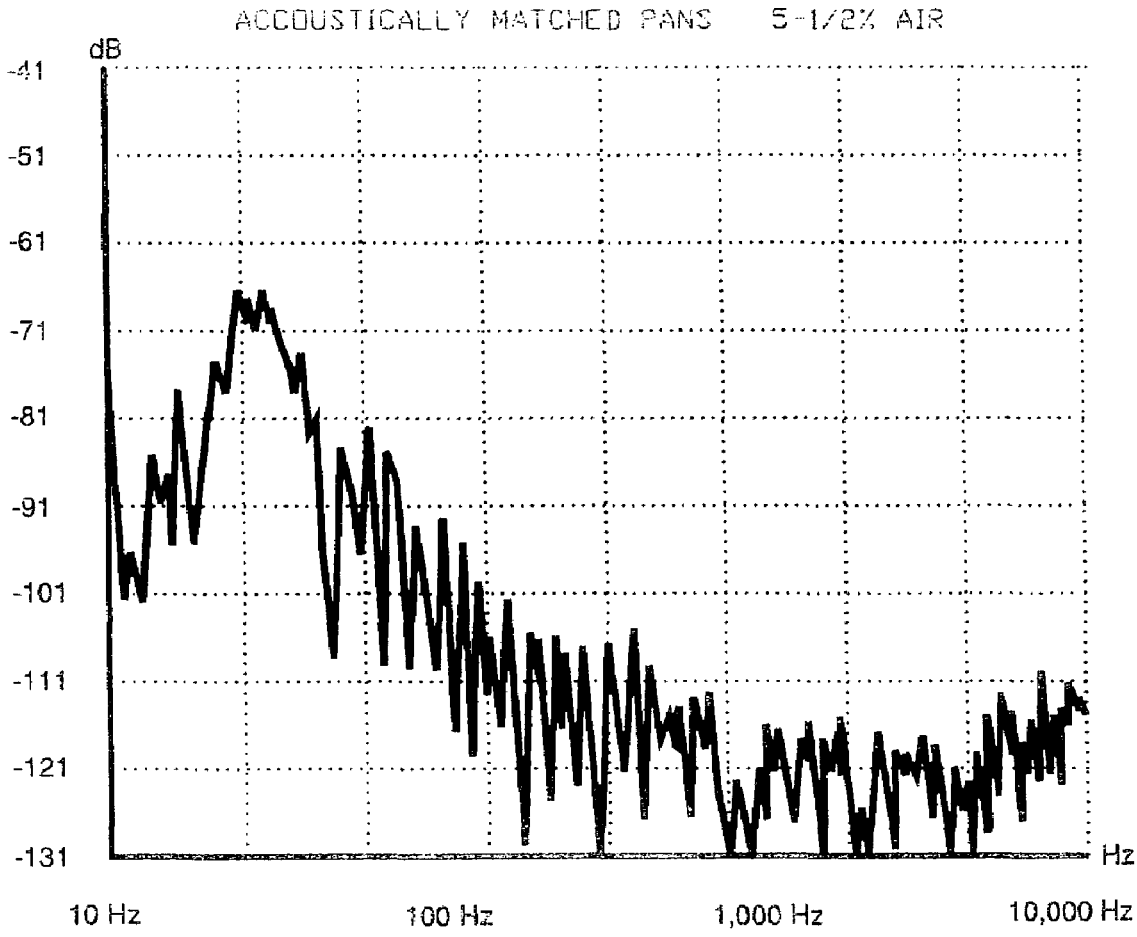
FIG. 10 is a graph similar to FIGS. 8 and 9 showing observed acoustic energy in a slab with 5.5% air entrainment being troweled with our new acoustically-matched pans.

FIG. 10 similarly shows an impedance-matched trowel pan (in this case fabricated from UHMW-PE), also operating over air-entrained concrete. The frequency spectrum is broader, having significant intensities at frequencies up to 120 Hz with a maximum intensity at about 40 Hz. The vibration intensity was higher, having a maximum value of −67 dB(v). This intensity is, on a linear scale, about six times that of the maximum measured for the steel pan. The combination of a higher intensity and a broader frequency spectrum demonstrates that there is much more energy transmitted from the rotating pans to the concrete slab when the acoustic impedance of the pans matches that of the concrete.

Figure 11:
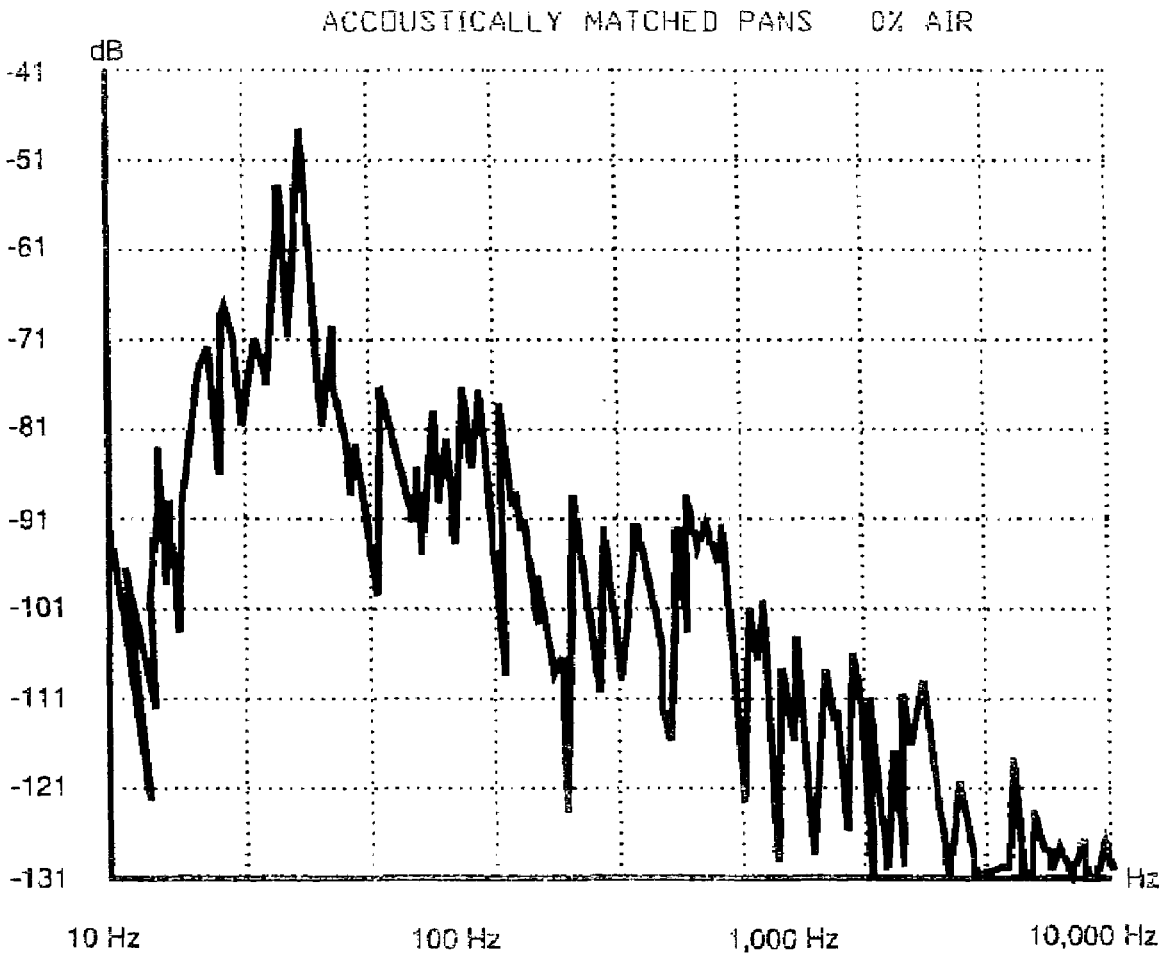
FIG. 11 is a graph similar to FIGS. 8–10 showing observed acoustic energy in a slab with zero percent air entrainment that is being troweled with our new acoustically-matched pans.
Figure 12:
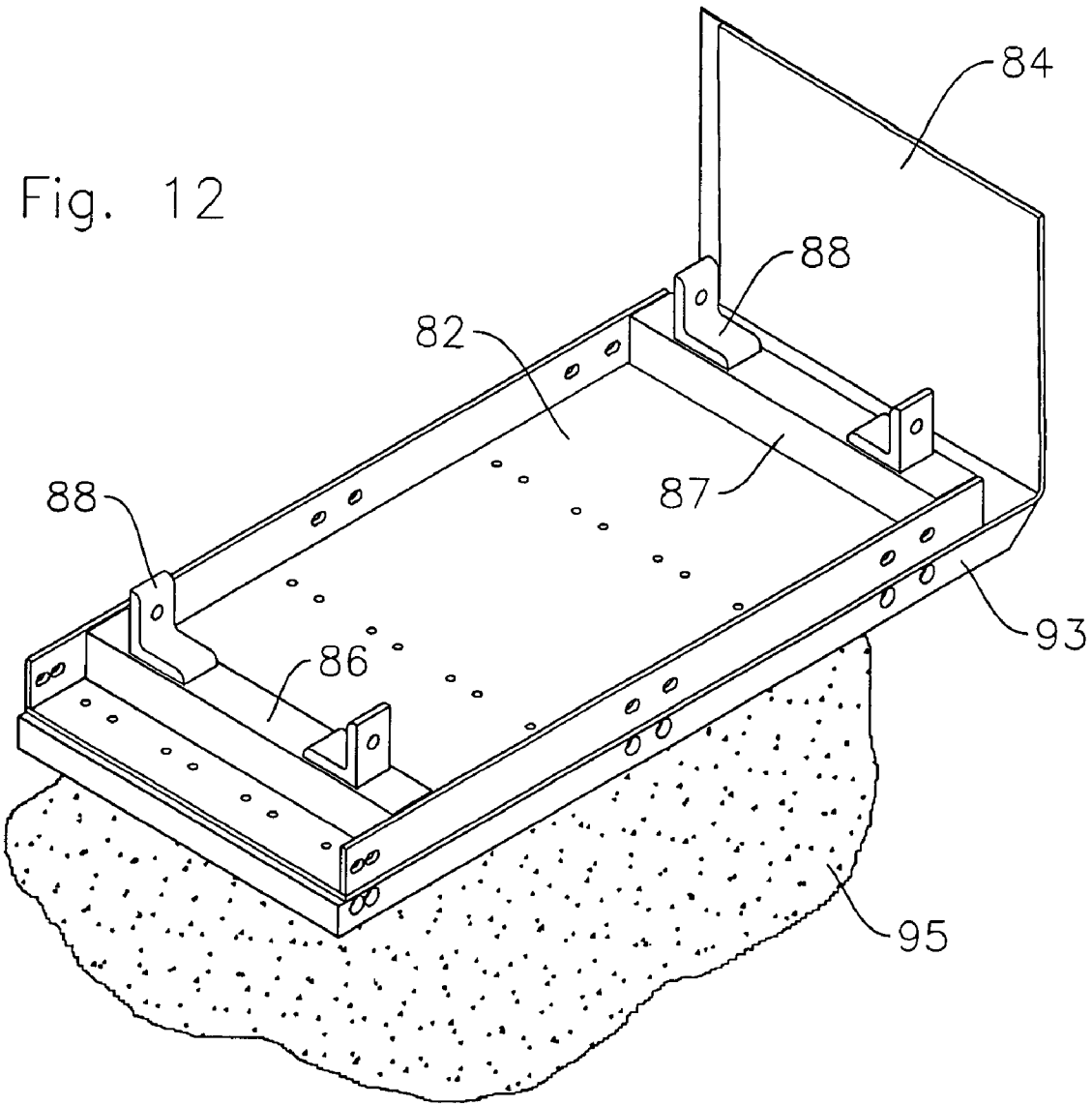
FIG. 12 is a fragmentary, isometric view of a portion of a slip forming machine, with portions thereof omitted for brevity.

FIG. 11 is a plot of the frequency spectrum of an impedance-matched pan, this time operating over non-air-entrained concrete. The improved vibration transmission into this material shows two effects, both of which enhance the effectiveness of the vibration. First, the impedance match of the concrete and the pans is closer so that more energy is put into the concrete. Second, the sound travels through the concrete more freely since it is not absorbed as strongly as the air-entrained material. As a result, the measured maximum vibration intensity is −46 dB(v), which is over 125 times the intensity shown in FIG. 3. Acoustic energy delivered to the concrete is spread over a wider frequency band, in this case up to a maximum effective frequency of over 1000 Hz.

Figure 13:
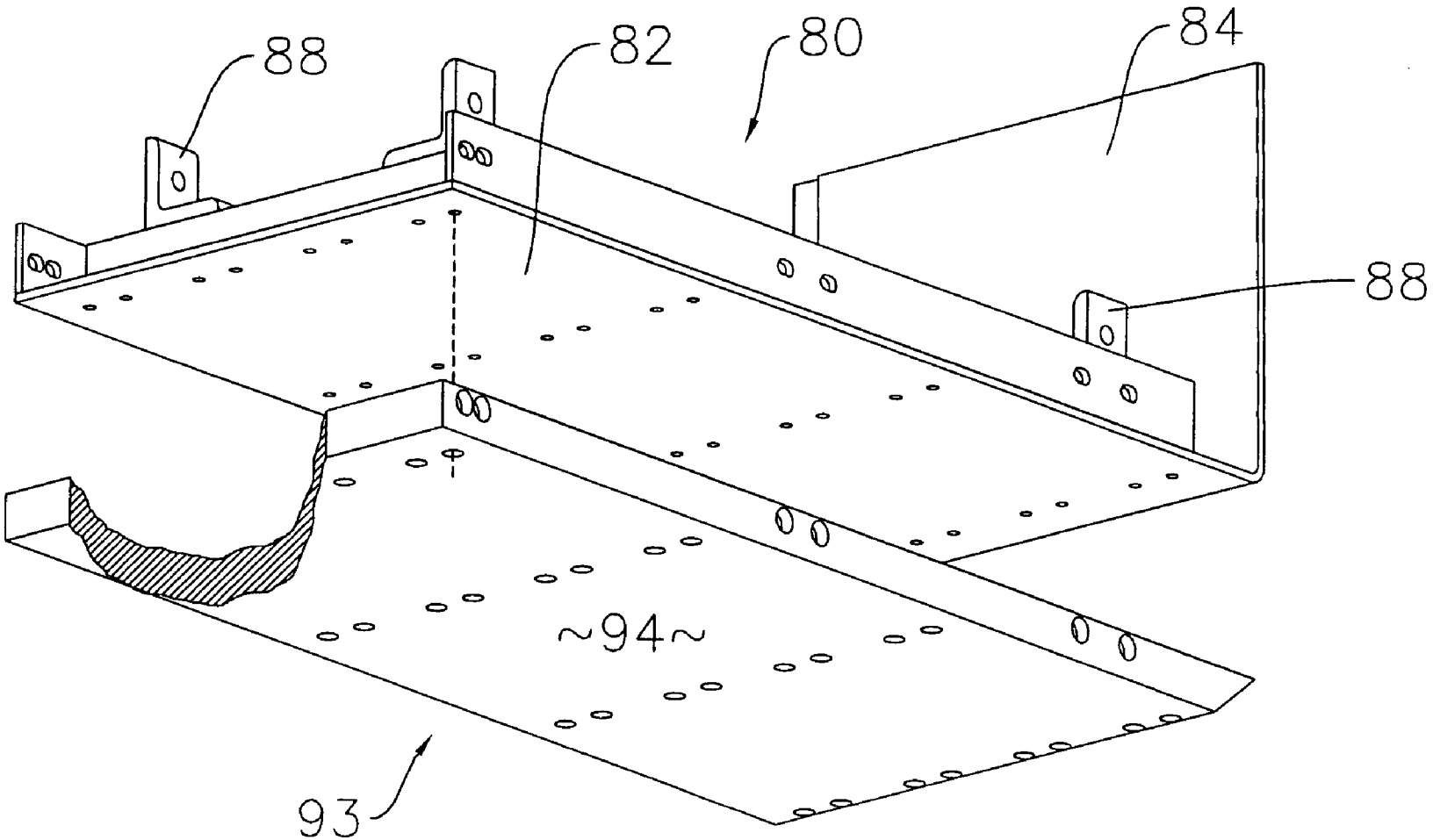
FIG. 13 is an exploded fragmentary isometric view similar to FIG. 12, showing the acoustically matched layer, and with portions shown in section for clarity.
Figure 14:
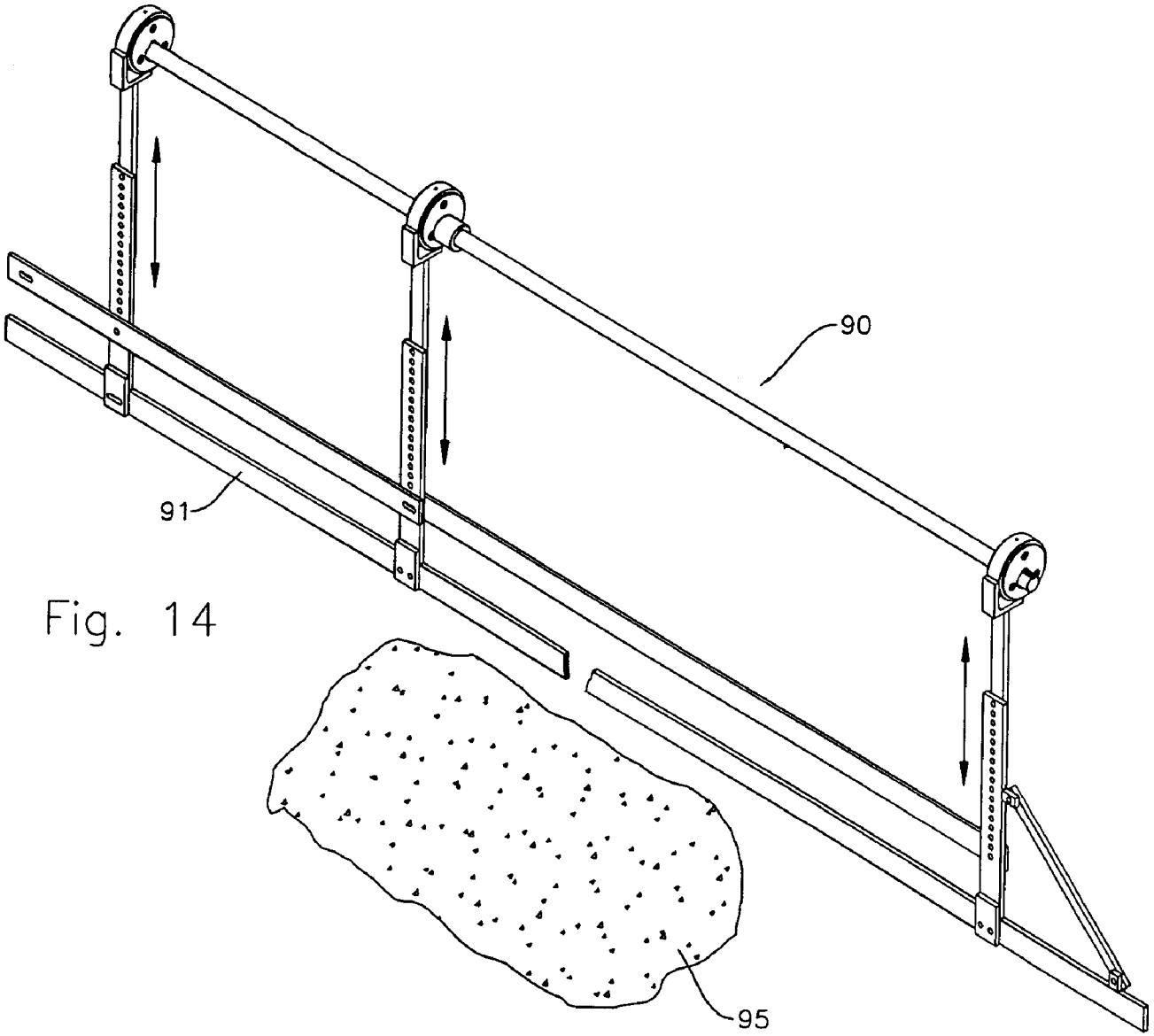
FIG. 14 is an abbreviated pictorial view of typical tamper bar construction used for slip form pavers.
Figure 15:
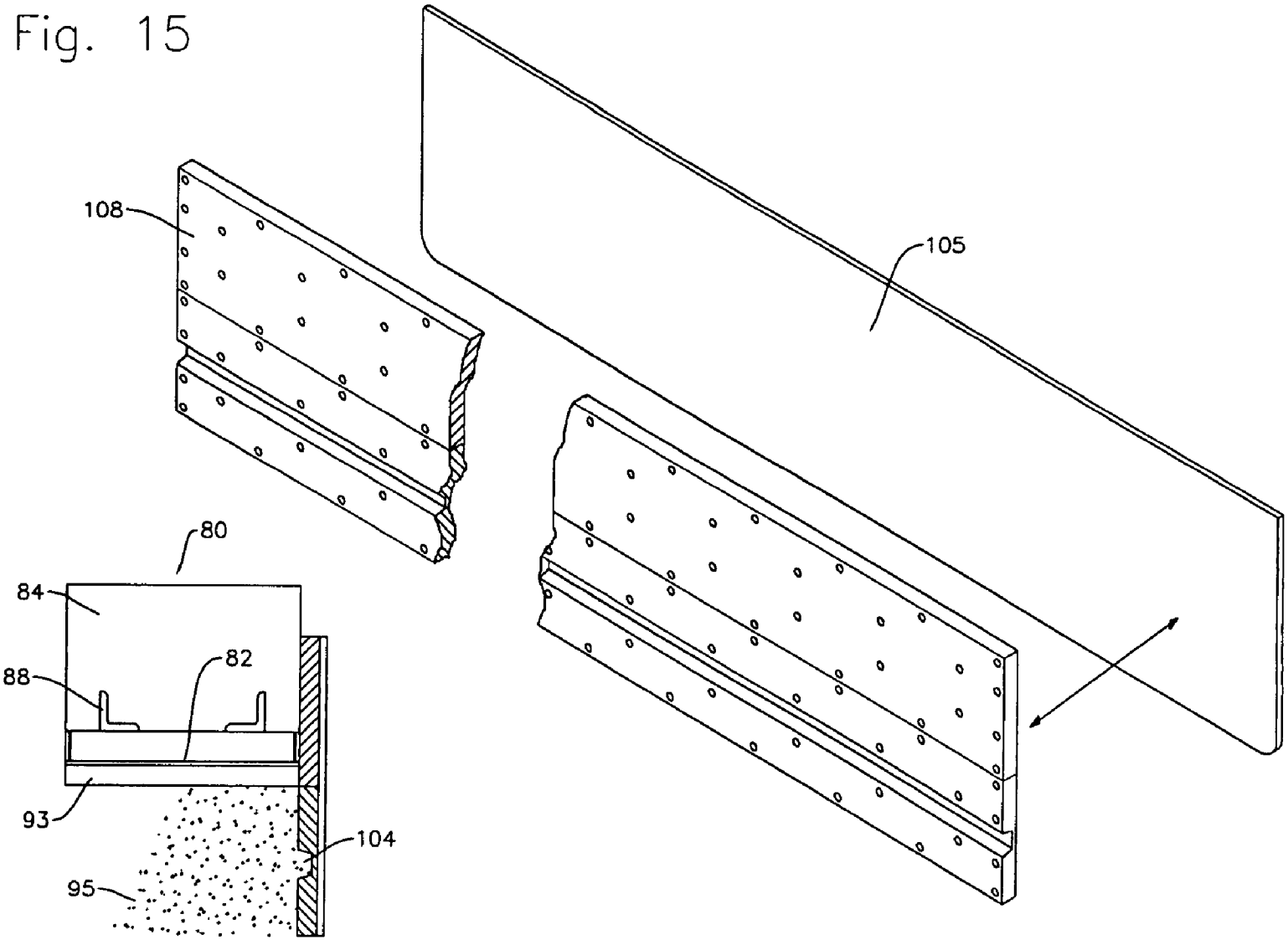
FIG. 15 is a fragmentary isometric view of the side form attachment used for slip form pavers.
Figure 16:
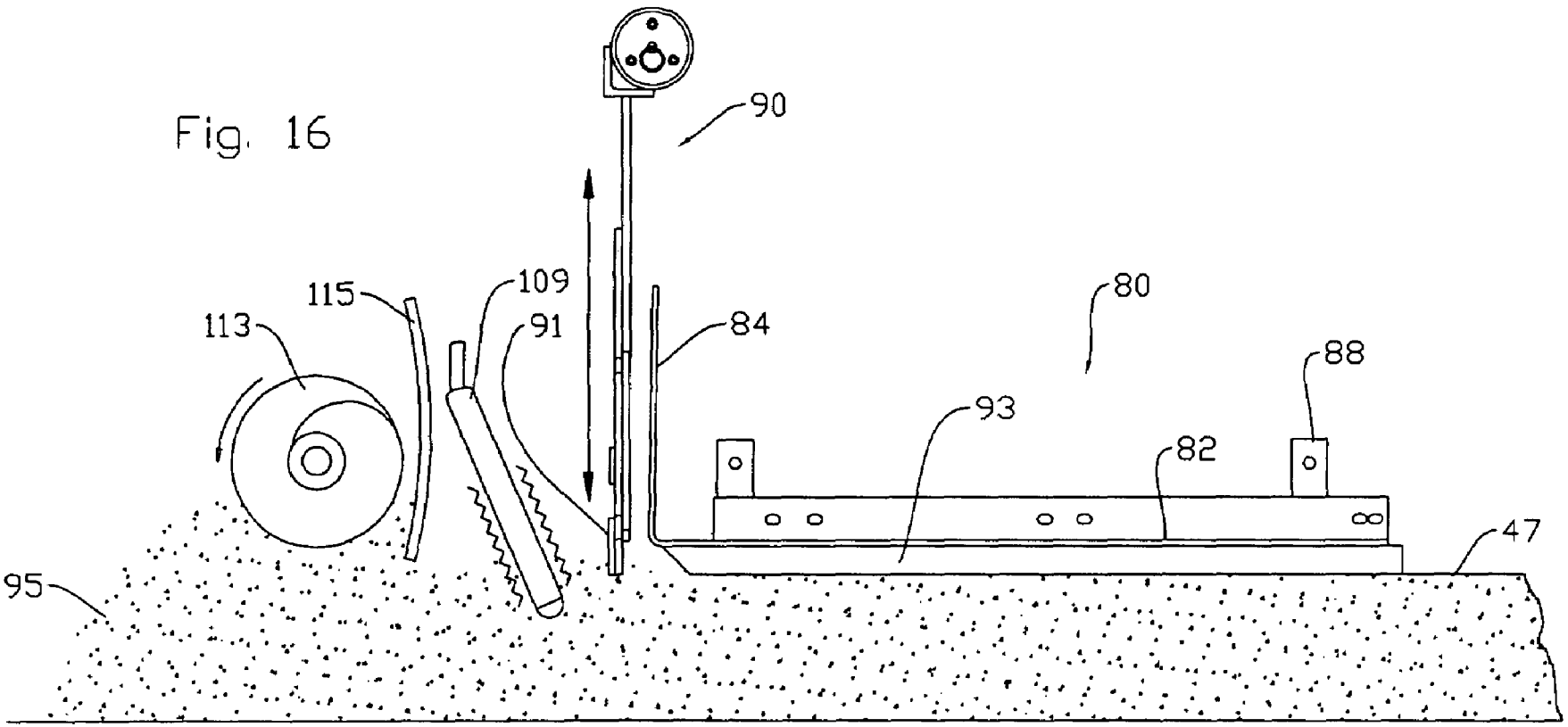
FIG. 16 is a side plan view of a typical slip forming machine.
Figure 17:
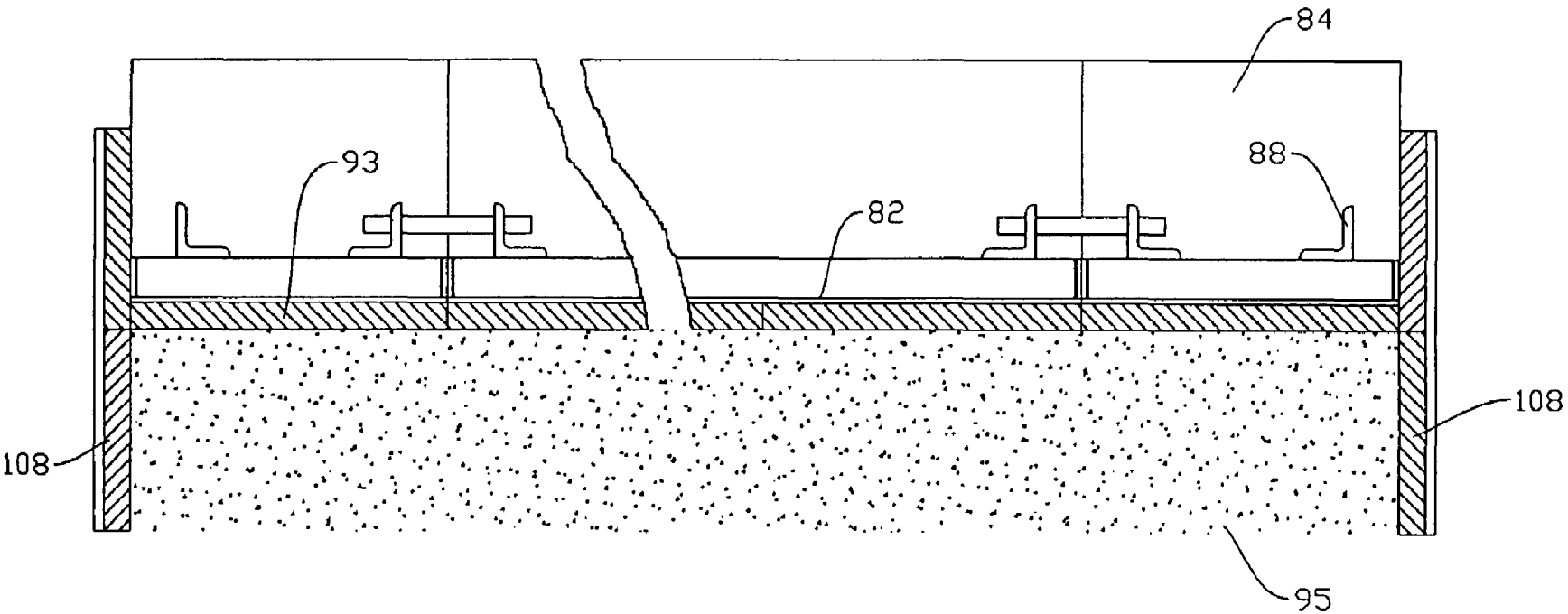
FIG. 17 is rear plan view of a typical setup for slip forming machine.

Turning now to FIGS. 12–15, improvements to slip form machines and slip form methodology will be described. As recognized by those skilled in the art, a typical slip form paver profile pan has been generally designated by the reference numeral 80 (FIG. 13). Profile pan 80 comprises a generally rectilinear, plate 82 (FIGS. 12, 13) with a steel member protruding vertically, designated by reference numeral 84. The spaced-apart cross braces 86, 87 support a plurality of upright joints 88 that enable conventional mechanical interconnection between adjoining pans for creating larger width concrete slabs. Importantly, a lower acoustic coupling plate 93 made of UHMW plastic material is secured beneath plate 82. Plate 93 is conformed and configured substantially as depicted to adjoin and bond to plate 82. Its undersurface 94 (FIG. 13) directly contacts raw concrete 95 (FIG. 12) during the pavement laying process to shape and solidify it. The conventional tamper bar actuator assembly 90 shown schematically in FIG. 14, residing directly in front of the profile pan, also utilizes the UHMW plastic material designated by reference numeral 91. In FIG. 15, the side form 105 comprised of heavy-duty steel acts as an edge for the concrete, eliminating the use of steel or wooden forms. Attaching the UHMW plastic material 108 to the side form allows the concrete to shape and solidify more preferably than without. This process also is the preferred method when adding keyways 104 to the concrete slab. FIG. 16 shows a side plan schematic view of the standard setup on a slip form paver. Reference numeral 113 illustrates an auger for distribution of the concrete to the entire machine. A heavy-duty plate 115 used for striking-off also assists in the distribution and settles the concrete for the next phase of the slip form process. The vibrators 109 are utilized to remove air from the concrete. All additional reference numerals noted have been previously discussed in FIGS. 11–15. FIG. 17 is a rear plan schematic view showing the paving pan and side form pan utilizing the UHMW plastic material on each.

EXAMPLE 1

Numerous six-inch concrete slabs were laid directly on a graded dirt base. The slabs were finished using dual-pan, power rider trowels employing acoustically matched float pans. The slabs were arranged in line, end to end, with the first slab at the southern-most position followed by subsequent slabs abutting toward the north. Slab edges to the east were defined by an existing slab of similar dimensions; all other edges were made of steel forms which were removed after the slabs achieved adequate strength. The forms at the abutting edges of these slabs were replaced with one-inch by six-inch wooden planks prior to pouring the next slab.

Thermocouples were placed in the forms before the concrete was poured, and acoustic spectral analysis was conducted during the finishing process to evaluate performance. UHMWPE pans with an impedance that matches fresh concrete were compared to steel pans with impedances about twenty times higher. The entrained air content of concrete was measured. Slab characteristics were as follows:

TABLE 7

Summary Of Slab Parameters

| Slab Designation | Slab #1 | | | Slab #2 | | Slab #3 |
|---|---|---|---|---|---|---|
| Ticket Number | 19929 | 19931 | 19938 | 19944 | 19946 | 19952 |
| Yards Delivered | 7.0 | 9.5 | 10.5 | 17.5 | 20.5 | 9.0 |
| Time On Ticket | 8:18 | 8:35 | 9:24 | 12:32 | 12:47 | 13:51 |
| Slump Measured | 4.5" | 5.5" | | 3" | | 4.75" |

TABLE 7-continued

Summary Of Slab Parameters

| Slab Designation | Slab #1 | | | Slab #2 | | Slab #3 |
|---|---|---|---|---|---|---|
| Entrained Air Measured | 6.5% | | | 5.5% | | 3.5% |
| Water Added | 8 gal | 0 | 4 gal | 23 gal | 10 gal | 0 |
| On Site Concrete Temperature | 84 deg | | | 87 deg | | 87 deg |

Flatness readings on adjacent finished slabs for forty-six inch steel pans and UHMWPE materials were as follows:

TABLE 8

Pan Flatness comparison:

| Segment | Steel Pan Flatness (Slab 1) | UHMWPE Flatness (Slab 2) |
|---|---|---|
| E-W North End | 45.1 | 21.3 |
| W-E South End | 55.6 | 38.5 |
| S-N East End | 37.5 | 27.6 |
| S-N West End | 36.7 | 35.4 |
| Overall | 42.1 | 28.4 |

Slab #1 was poured, allowed to set, floated with a regular steel pan and then troweled with steel blades, all using a 46" power trowel. When floating was complete on the first slab, the second slab was poured. There was a delay between pouring the first and second loads of concrete, so floating of the first portion of the second slab approached completion before the second portion was ready to float. The situation was intensified due to the apparent high slump of the second load of concrete, although that slump was not measured. In any case, floating of the second slab required nearly two hours. The second slab experienced very little surface delamination, despite entrained air. In contrast, the first slab showed delamination, although it was not troweled before the water sheen had dissipated.

EXAMPLE 2

On Oct. 22–23, 2002, at Paragould, Ark., four, six-inch thick concrete slabs were placed in forms directly on a graded dirt base completely covered with polyethylene sheeting. The slabs were finished with dual-pan, power rider trowels driving several types of specially designed float pans. Thermocouples were placed in the forms before the concrete was poured, and acoustic spectral analysis was conducted during the finishing process to aid in evaluating the performance of the pans as was done previously. A first set of pans was made of ceramic-impregnated UHMWPE and mounted beneath a steel disc of the same diameter. The ceramic-impregnated material was found to be more abrasion-resistant than unmodified UHMWPE materials. A second set of ceramic-impregnated UHMWPE pans used reduced-diameter steel backing (i.e., 15% of the diameter of the plastic pan). It was determined that an acceptable material should have an abrasion resistance of no greater than 150 (measured using ASTM Method G-65, with steel having a rating of 100; a lower rating has greater abrasion resistance.) Finally, normal steel pans that were spray-coated with polyurethane for abrasion-resistance were used.

TABLE 9

Impedance Matching Results

| Slab | Material | Diameter | F-Meter | Dimensions | Concrete |
|---|---|---|---|---|---|
| 1 | UHMWPE pans laminated beneath a steel disc | 36 Inch | Overall 50.1 Ff | 19'9" × 14'4" | Air Entrained, No Calcium |
| 2 | Steel pans with sprayed polyurethane coating | 46 Inch | Overall 55.6 Ff | 29'6" × 14'4" | Air Entrained, With Calcium |
| 3 | UHMWPE pans beneath small disc | 46 Inch | Overall 41.0 Ff | 19'9" × 14'4" | No Calcium |
| 4 | Steel pans with sprayed polyurethane coating | 46 Inch | Overall 48.4 Ff | 15'3" × 9'9" | No Calcium |

EXAMPLE 3

On Nov. 8, 2002, at Paragould, four, six-inch thick slabs were laid directly on a graded dirt base that was completely covered with polyethylene sheeting. The concrete was air entrained, with no calcium additives. The slabs were finished using dual-pan power rider trowels driving several types of specially designed float pans. Thermocouples were placed in the forms before the concrete was poured, and acoustic spectral analysis was conducted during the finishing process to aid in evaluating the performance of the pans, as was done previously. The first slab was finished with normal steel pans without modification, as a control. The second slab was finished with ceramic-impregnated UHMWPE pans mounted beneath a steel disc of the same diameter. The third slab was finished with normal steel pans that were spray-coated with a polyurethane compound that is extremely abrasion-resistant. A fourth slab was finished with ceramic-impregnated UHMWPE pans and mounted beneath a reduced-diameter steel backing disc (i.e., 15% of the diameter of the plastic pan), which used to support the curvature of the pan. The urethane-coated pans used for finishing the third slab failed quickly; the coating deteriorated and large segments of it very rapidly peeled off. After a brief delay, the same trowel used on the fourth slab finished the third slab.

TABLE 10

Delamination Characteristic of Finished Concrete

| Slab | Material | Diameter | Delamination |
|---|---|---|---|
| 1 | Steel Pans | 36 Inch | Apparent |
| 2 | Ceramic-impregnated UHMWPE pans | 46 Inch | Reduced |
| 3 | Steel pans with sprayed polyurethane coating followed by UHMWPE pans beneath small central steel disc | 46 Inch | Apparent |
| 4 | UHMWPE pans beneath smaller steel disc | 36 Inch | Reduced |

EXAMPLE 4

On Dec. 11, 2002, at Paragould, Ark., three six-inch thick concrete slabs were laid directly on a graded dirt base completely covered with polyethylene sheeting. The concrete was air-entrained, without calcium additives. The slabs were finished with dual-pan power rider trowels driving the three types of float pans as discussed in Example 3. Three pan designs were used. The pans were the same ones used in previous tests, to further study the abrasion resistance and durability of plastic pans. Observed results were as follows:

TABLE 11

Test Results for Impedance Matching Method

| Slab | Pan Material | Pan Diameter | F-Meter Overall |
|---|---|---|---|
| 1 | Steel | 46 inch | 79.5 Ff |
| 2 | Ceramic UHMWPE Compound | 46 inch | 45.9 Ff |
| 3 | UHMWPE W/No Backing | 46 inch | 50.9 Ff |

The first slab, which was finished with normal steel pans, exhibited extensive delamination. The third slab, which was finished with UHMWPE pans, had no observable delamination. We determined that the normal practice of power-troweling with materials having a significantly different acoustic impedance from that of fresh concrete contributes significantly to delamination. In other words, the use of pans made of steel (Z~46) upon low-slump fresh concrete (Z~2.7) results in a detrimental acoustic impedance mismatch. Another mismatch is obtained from the combination of high-slump concrete (Z~1.8) and ceramic-impregnated UHMWPE (Z~3.4). Pans of unmodified UHMWPE with an acoustic impedance of approximately 2.1 are closely matched in impedance to both low-slump and high-slump fresh concrete. The data shown, typical of that taken in tests of acoustic impedance-matched concrete finishing equipment, shows clearly the advantages of our acoustic impedance matching apparatus and finishing methods.

From the foregoing, it will be seen that this invention is one well adapted to obtain all the ends and objects herein set forth, together with other advantages which are inherent to the illustrated structure and methods.

It will be understood that certain features and subcombinations are of utility and may be employed without reference to other features and subcombinations. This is contemplated by and is within the scope of the claims.

As many possible embodiments may be made of the invention without departing from the scope thereof. It is to be understood that all matter herein set forth or shown in the accompanying drawings is to be interpreted as illustrative and not in a limiting sense.

What is claimed is:

1. A pan for concrete finishing trowels of the type comprising one or more revolving rotors that contact the concrete surface, the pan comprising:

a body made from a material characterized by an acoustic impedance approximating the acoustic impedance of plastic concrete; and, means for coupling said body to said rotor.

2. The pan as defined in claim 1 wherein said pans are made from ultra-high molecular weight polyethylene (UHMWPE) plastic.

3. In a powered concrete trowel for power troweling and finishing plastic concrete, the concrete characterized by an acoustic impedance, and the trowel comprising at least one revolving rotor, the improvement comprising a finishing pan adapted to be fitted to said at least one rotor that is made from a material characterized by an acoustic impedance approximating the acoustic impedance of said plastic concrete, whereby outputted acoustic energy is optimally transferred to the plastic concrete.

4. The improvement as defined in claim 3 wherein said pans are made from ultra-high molecular weight polyethylene (UHMWPE) plastic.

5. The improvement as defined in claim 3 wherein said pans are fabricated from a material that has an acoustic impedance within 67% to 150% of the acoustic impedance of the fresh concrete being finished by the power trowel.

6. The improvement as defined in claim 5 wherein said material has an abrasion resistance of no greater than 150 measured using ASTM Method G-65 where steel is given a rating of 100.

7. In a powered concrete trowel for power troweling and finishing plastic concrete, the concrete characterized by an acoustic impedance, and the trowel comprising at least one revolving rotor, the improvement comprising a finishing pan having a subframe adapted to be fitted to said at least one rotor and a layer of acoustic impedance matching material secured to said subframe, said material characterized by an acoustic impedance approximating the acoustic impedance of said plastic concrete.

8. The improvement as defined in claim 7 wherein said pans are made from ultra-high molecular weight polyethylene (UHMWPE) plastic.

9. The improvement as defined in claim 8 wherein said pans are fabricated from a material that has an acoustic impedance within 67% to 150% of the acoustic impedance of the fresh concrete being finished by the power trowel.

10. The improvement as defined in claim 9 wherein said material has an abrasion resistance of no greater than 150 measured using ASTM Method G-65 where steel is given a rating of 100.

11. A finishing pan for a power concrete trowel for finishing plastic concrete, the concrete characterized by an acoustic impedance, and the trowel comprising at least one revolving rotor, the pan comprising;

a metal subframe adapted to be coupled to said at least one rotor;

a layer of acoustic impedance matching material secured to said subframe, said material characterized by an acoustic impedance approximating the acoustic impedance of said plastic concrete; and, whereby outputted acoustic energy is optimally transferred to the plastic concrete.

12. The pan as defined in claim 11 wherein said acoustic impedance matching layer comprises ultra-high molecular weight polyethylene (UHMWPE) plastic.

13. The pan as defined in claim 11 wherein said acoustic impedance matching material has an acoustic impedance within 67% to 150% of the acoustic impedance of the concrete being finished.

14. The pan as defined in claim 13 wherein acoustic impedance matching material has an abrasion resistance of no greater than 150 measured using ASTM Method G-65 where steel is given a rating of 100.

* * * * *